US007954339B2

(12) United States Patent
Gibbon

(10) Patent No.: US 7,954,339 B2
(45) Date of Patent: Jun. 7, 2011

(54) APPARATUS FOR CRYOGENIC AIR DISTILLATION

(75) Inventor: Stephen John Gibbon, Banstead (GB)

(73) Assignee: Air Products & Chemicals, Inc., Allentown, PA (US)

( * ) Notice: Subject to any disclaimer, the term of this patent is extended or adjusted under 35 U.S.C. 154(b) by 832 days.

(21) Appl. No.: 10/550,569

(22) PCT Filed: Mar. 29, 2004

(86) PCT No.: PCT/GB2004/001343
§ 371 (c)(1),
(2), (4) Date: Jul. 10, 2006

(87) PCT Pub. No.: WO2004/088228
PCT Pub. Date: Oct. 14, 2004

(65) Prior Publication Data

US 2006/0260357 A1 Nov. 23, 2006

(30) Foreign Application Priority Data

Mar. 31, 2003 (GB) ..... 0307404.4

(51) Int. Cl.
*F25J 3/00* (2006.01)

(52) U.S. Cl. ..... 62/643; 62/905; 62/911

(58) Field of Classification Search ..... 62/643, 62/900, 902, 911
See application file for complete search history.

(56) References Cited

U.S. PATENT DOCUMENTS 4,224,045 A * 9/1980 Olszewski et al. ..... 62/646
4,254,629 A * 3/1981 Olszewski ..... 62/651
4,529,425 A * 7/1985 McNeil ..... 62/650
4,560,397 A * 12/1985 Cheung ..... 62/652
4,957,523 A * 9/1990 Zarate et al. ..... 62/646
5,165,245 A * 11/1992 Agrawal et al. ..... 62/646
5,349,827 A 9/1994 Bracque et al.
5,412,954 A * 5/1995 Grenier ..... 62/646
(Continued)

FOREIGN PATENT DOCUMENTS

DE 2822774 A1 5/1978
(Continued)

OTHER PUBLICATIONS

International Search Report dated Jun. 30, 2004.

*Primary Examiner* — Cheryl J Tyler
*Assistant Examiner* — John F Pettitt
(74) *Attorney, Agent, or Firm* — Caesar, Rivise, Bernstein, Cohen & Pokotilow, Ltd.

(57) ABSTRACT

An apparatus for the cryogenic distillation of air includes an assembled unit that has a first distillation column module within which is provided a cryogenic distillation column; a heat exchange module within which is provided heat exchange means for cooling column feed air to a cryogenic distillation temperature; and at least one further processing unit. The or each distillation column, the heat exchange means, and the or each further processing unit are operationally interconnected, and the assembled unit is suitable for transportation to and erection at the site for a cryogenic air separation plant. Construction of a cryogenic air distillation plant is simplified resulting in a reduction in construction cost and time of construction. In addition, as components of the apparatus are self-contained within modules, the risk of contamination of the internal components is reduced, thus improving control of the quality of the construction.

22 Claims, 1 Drawing Sheet

U.S. PATENT DOCUMENTS

| | | | | |
|---|---|---|---|---|
| 5,461,871 | A | 10/1995 | Bracque et al. | |
| 6,128,921 | A | 10/2000 | Guillard et al. | |
| 6,134,915 | A * | 10/2000 | Denzau et al. | 62/643 |
| 6,148,637 | A * | 11/2000 | Guillard et al. | 62/643 |
| 6,167,723 | B1 * | 1/2001 | Guillard | 62/646 |
| 2001/0018829 | A1 * | 9/2001 | Wagner | 62/54.3 |
| 2004/0000166 | A1 * | 1/2004 | Moeller et al. | 62/643 |
| 2004/0035149 | A1 | 2/2004 | Moeller et al. | |
| 2004/0050095 | A1 * | 3/2004 | Brigham et al. | 62/643 |

FOREIGN PATENT DOCUMENTS

| | | | |
|---|---|---|---|
| DE | 10051141 | A1 | 10/2000 |
| EP | 1103772 | A1 | 1/2000 |
| EP | 1041353 | A2 | 2/2000 |
| EP | 1182412 | A1 | 10/2000 |
| EP | 1314942 | A2 | 11/2002 |
| FR | 2780147 | A1 | 6/1999 |
| GB | 2358909 | A | 10/2000 |

* cited by examiner

APPARATUS FOR CRYOGENIC AIR DISTILLATION

BACKGROUND OF THE INVENTION

The present invention relates to apparatus for the cryogenic distillation of air and, in particular, relates to a modular apparatus, methods of construction and transportation of said apparatus and use of said apparatus to distil air.

The present invention is of particular use in the construction of air distillation plants by the coast having dockside facilities including heavy duty lifting equipment. In addition, the present invention is primarily concerned with the production of oxygen from air distillation plants but, as would be readily appreciated by the skilled person, it is readily applicable to the production of other products from the cryogenic distillation of air.

A cryogenic air separation process typically comprises the removal impurities such as carbon dioxide and water from feed air. The purified air is then compressed and cooled to a cryogenic temperature and is then fed to a cryogenic distillation system in which it may be separated into oxygen products, nitrogen products and rare gas products such as argon, xenon and krypton.

The cryogenic distillation system may comprise a single distillation column but typically comprises a high pressure column thermally integrated with a low pressure column and may further comprise an auxiliary column, such as an argon side-arm column, if rare gas products are required.

In a dual-column system, the cooled compressed feed air is fed to the high pressure column where it is separated into an oxygen-enriched bottoms liquid and a nitrogen-enriched overhead vapour. At least a portion of the oxygen-enriched bottoms liquid is fed to the low pressure column after appropriate pressure reduction where it is separated into liquid oxygen and low pressure nitrogen overhead vapour. At least a portion of the nitrogen-enriched overhead vapour from the high pressure column is condensed by indirect heat exchange against liquid oxygen in a reboiler-condenser located in the sump of the low pressure column. At least a portion of the resultant liquefied nitrogen-enriched overhead vapour is fed back to the high pressure column as reflux for the distillation. A portion of the liquefied nitrogen vapour may be removed as product and liquid oxygen may be removed as product from the low pressure column. There are numerous variations of this process known to the person skilled in the art.

Construction of an air separation plant is complex and is usually carried out by specialist construction engineers. As a consequence, it is usually time-consuming and expensive. On-site construction has been simplified to a certain extent by the use of a modular approach in which modules containing components for the air separation plant are transported to the plant site and interconnected on-site. Examples of such a modular approach are disclosed in U.S. Pat. No. 5,461,871 (Bracque et al) and EP-A-1314942 (Stringer et al).

In the system disclosed in U.S. Pat. No. 5,461,871, the principle air compression components are housed in one module, the "warm" elements (other than those required for compression and purification) are housed in a second module and the "cold" elements such as the principle heat exchanger are housed in a third module. The second and third modules are of parallelepipedal shape whose external dimensions permit road transport. Alternatively, the second and third modules may be connected into a single module transportable by road. Once transported to the plant site, the modules are assembled with the other components such as the distillation column system. It is disclosed that such a modular system is suitable for plants producing tens of tons per day of oxygen.

EP-A-1314942 also discloses a modular system for the construction of air separation plants. In this system, first and second modules are selected from libraries of modules according to the design of the plant being constructed. The first module preferably comprises a high pressure distillation column and the second module preferably comprises a main heat exchanger. A low pressure distillation column may be contained within a third module selected from a third module library. The modules of each library each have a set of interface points that are arranged having substantially the same relative spatial co-ordinates thereby allowing each member of one library to be connected to each member of another library. The selected modules are transported to site where they are assembled into the plant. It is disclosed that this system may be used in the construction of plants producing 200-2000 metric tons/day of gas.

In existing modular systems, the modules still have to be assembled on-site which is both time-consuming and requires skilled engineers. There is a need, therefore, for a new air separation plant, the construction of which is simplified, less expensive and less time consuming than the construction of existing plants.

In typical air separation plants, the components are generally spread out over the ground within a defined area. Where space is restricted, it would be desirable to reduce the ground area taken up by the footprint of the air separation plant.

The components of an air separation plant are usually manufactured in one location and transported to the site of the plant for assembly. More often than not, the plant site is in a different country to the country of manufacture and, thus, the components are usually transported to the plant site by sea. As specialist construction engineers are required to assemble the plant, it is often necessary to send engineers abroad for considerable lengths of time. This is expensive and, in certain parts of the world, may even be dangerous to the health and safety of the engineers. There is a further need, therefore, for a new air separation plant which may be constructed at less cost and with less risk to health and safety of the engineers.

The site of the air separation plant could potentially be anywhere in the world. As the plant is usually transported to site in its component parts, there is a risk of contamination of the interior components of the plant which could have a significant deleterious effect on the operational efficiency of the plant. This is especially relevant to plants having one or more large distillation columns, e.g. columns having a diameter of over 3.5 m and usually about 5 m or 6 m. Such columns at present may be transported in sections and, thus, the inner surfaces of the column sections may be exposed. Contaminants include dirt and grease and may be airborne. Some contaminants may even be corrosive, for example salt, or erosive and/or abrasive, for example sand. There is a need, therefore, for a new air separation plant which may be constructed with less risk of contamination of the interior components and hence less risk of a reduction in the operational efficiency of the plant and associated operating costs.

BRIEF SUMMARY OF THE INVENTION

According to the first aspect of the present invention, there is provided apparatus for the cryogenic distillation of air, said apparatus comprising an assembled unit that comprises:

a first distillation column module within which is provided at least one cryogenic distillation column;

a heat exchange module within which is provided heat exchange means for cooling column feed air to a cryogenic distillation temperature; and at least one further processing unit;

wherein the or each distillation column, said heat exchange means and the or each further processing unit are operationally interconnected and said assembled unit is suitable for transportation to and erection at a site for a cryogenic air separation plant.

The heat exchange module may be mounted at the base of and adjacent to said first distillation column module. Such embodiments are particularly applicable to plants comprising at least one large distillation column. The heat exchange module may alternatively be mounted under the base of the first distillation column module. Such embodiments are particularly applicable to plants having at least one small distillation column, e.g. a column having a diameter of no more than 3 m.

The use of the expression "operationally interconnected" is intended to include embodiments in which the components of the apparatus are connected in order ready for operation.

A modular construction of the air distillation apparatus into a pre-assembled unit simplifies the on-site assembly of the apparatus which in turn reduces the assembly/installation time and associated cost. There is a significant reduction in the manpower required to assemble the apparatus on-site and specialist construction engineers may not be required for on-site assembly of the modules and/or installation of the pre-assembled unit on site. The present invention is applicable to the construction of both large and small air distillation plants. In this connection, the apparatus is suitable for construction of a plant designed to produce over 2000 metric tons/day of gas product, for example at least 3500 metric tons/day of oxygen.

Most air separation plants operate a multiple distillation column system. In such cases, the first distillation column module may comprise a single cryogenic distillation column. The apparatus may then further comprise at least one further distillation column module within which or each of which is provided at least one further cryogenic distillation column. In these embodiments, the or at least one further distillation column module may be mounted on the first distillation column module and the or each further cryogenic distillation column is operationally interconnected with the single cryogenic distillation column of the first distillation column module.

Preferably, the first distillation column module comprises a high pressure distillation column. Such a high pressure column typically operates at a pressure within a range between from about 3 to about 11 bara (0.3 to 1.1 MPa). In such embodiments, the apparatus preferably further comprising a second distillation column module within which is provided a low pressure cryogenic distillation column. A low pressure column typically operates at a pressure within a range between from about 1 to about 4 bara (0.1 to 0.4 MPa). Where high purity oxygen or rare gas products are required, the apparatus may further comprise a third distillation column module within which is provided an auxiliary distillation column or an argon side-arm column, said auxiliary distillation column or said argon side-arm column being operationally interconnected with the high and/or low pressure distillation columns as required. The column of the third distillation column module may operate at a pressure between the operating pressures of the high pressure and the low pressure column or may operate at about the pressure of the low pressure column depending on the process requirements.

In preferred embodiments, the or each distillation column module is a "cold box" and insulates the or each cryogenic distillation column provided therein. In addition, pipe work for connecting the or each column in fluid flow communication with other components of the apparatus is preferably provided within the module. Both of these features further reduce the time, cost and complexity of assembly of the apparatus.

Preferably, the heat exchange module also comprises pipe work for connecting the heat exchange means in fluid flow communication with other components of the apparatus. This feature also further reduces the time, cost and complexity of assembly of the apparatus.

In preferred embodiments, therefore, components are provided in self-contained modules protecting the components from contamination. The modules would usually include associated pipe work and insulation if required. The apparatus is simply built up from the required number and type of the modules.

For a large distillation column, the dimensions of the individual cold box that makes up part of the assembled unit may up to a maximum of from about 6 m by 6 m by 35 m. The dimensions of the assembled unit may be up to a maximum of from about 16 m by 16 m by 70 m The apparatus comprises one or more further purification units. If more than one further purification unit is used, the units may be the same or different.

The or at least one further processing unit is usually an air purification unit. In such embodiments, the air purification unit comprises at least two air purification vessels, each vessel comprising at least one bed of carbon dioxide and/or water adsorbent material, said vessels being arranged in parallel and configured for use in a temperature or a pressure swing adsorption process.

In further embodiments, one or more of the further processing units, for example a fluid processing unit, may be selected from a compressor for compressing feed air or other process gases, an expander for expanding liquid or gas streams, a chiller tower for cooling process water streams, a product compressor for compressing distillation products, a recycle compressor for compressing recycled gas stream(s), a pump for pumping distillation products, a "deoxo" unit for removing trace oxygen from a product gas stream, a dump vaporiser for vaporising liquid inventory from the apparatus, a silencer for reducing the noise given off by any process stream, a warm heat exchanger for warming process gas streams or a DCAC for cooling and drying air discharged from a compressor. In preferred embodiments, one or more, e.g. two, chiller towers are used. The or at least one of the further processing units may be a storage unit for storing distillation products.

One preferred embodiment of the apparatus comprises at least one distillation column module, a heat exchange module and an air purification unit. Another preferred embodiment comprises at least one distillation column module, a heat exchange module and at least one chiller tower. A further preferred embodiment comprises at least one distillation column module, a heat exchange module and at least one storage unit.

The or at least one further processing unit is preferably provided within at least one further processing unit module within which is provided pipe work for operational interconnection of the or each further processing unit in fluid flow communication with other components of the apparatus. By increasing the number of modules used in the construction of the apparatus, the assembly is further simplified.

The modules may either be attached directly to each other or to a framework of support members for supporting the components of the apparatus. One advantage of using a framework is that the structural integrity of the apparatus is increased thereby reducing the risk that the apparatus will be damaged, e.g. by buckling, when erected on site.

Where a framework is used, the apparatus may further comprise panels provided between adjacent support members forming at least one enclosure within the framework. The or at least one further processing unit may be provided within the enclosure. Alternatively, in embodiments comprising at least one chiller tower, the enclosure may form the outer walls of the tower itself.

Suitable apparatus may be substantially as hereinbefore described with reference to the accompanying drawing.

According to a second aspect of the present invention, there is provided a method for the construction of apparatus according to the first aspect of the invention. The method comprises:

providing a heat exchange module within which is provided heat exchange means for cooling column feed air to a cryogenic temperature and at least one further processing unit in position relative to a first distillation column module within which is provided at least one cryogenic distillation column;

interconnecting operationally the or each distillation column, the heat exchange means and the or each further processing unit; and attaching the heat exchange module and the or each further processing unit in position relative to the first distillation column module to form an assembled unit suitable for transportation to and erection at a site for a cryogenic air separation plant.

Where further distillation column modules are required, the method may further comprise:

providing at least one further distillation column module within which is provided at least one further distillation column in position relative to the first distillation column module;

interconnecting operationally the or each further distillation column module and other components of the apparatus; and attaching the or each further distillation column module in position relative to the first distillation column module.

In preferred embodiments, the or each distillation column module and the heat exchange module comprise pipe work for operational interconnection of components of the apparatus. The method may then comprise connecting the components of the apparatus in fluid flow communication via the pipe work. In addition or alternatively, where the or at least one further processing unit is provided within at least one further processing unit module comprising pipe work for operational interconnection with other components of the apparatus, the method further comprises connecting the or each further processing unit in fluid flow communication with other components of the apparatus via the pipe work.

In such preferred embodiments, the components of the apparatus are simply positioned adjacent to each other in their required positions relative to the first distillation column module and the final piping connections are made. The components are then attached to each other. Each component of the apparatus may either be attached directly to at least one adjacent component or may be attached in position relative the first distillation column module by a framework of support members. The components are usually welded in position.

A suitable method may be substantially as hereinbefore described with reference to the accompanying drawing.

In a third aspect of the present invention, there is provided a method for the construction of a cryogenic air separation plant comprising constructing apparatus according to the method of the second aspect to produce an assembled unit, transporting the assembled unit to the site for the plant and erecting the assembled unit on site.

In preferred embodiments of the third aspect, construction takes place at a dockside or a construction facility with access to a dockside prior to transportation to site by sea. Once the assembled unit is constructed, it is then loaded on to a sea transport, e.g. a ship or sea-going barge, and transported to the site of the proposed plant. The assembled unit is then hoisted into position, thus, negating the need for specialist welders on site.

One advantage of transporting and erecting an assembled unit is that the risk of contamination of the internal components of the apparatus is significantly reduced. Quality of construction can, therefore, be controlled to a greater degree than previously possible with plants constructed on site. In addition, it may no longer be necessary to send specialist construction engineers (or at least as many engineers) to site to erect the apparatus thereby reducing the construction cost and time of construction. If local engineers are competent to erect the assembled unit, then there is no need to send any construction engineers to site which removes the risk of danger to the health and safety of the engineers who might otherwise have had to have been sent to the plant site.

According to a fourth aspect of the present invention, there is provided use of apparatus according to the first aspect of the present invention to distil air.

According to a fifth aspect of the present invention, there is provided use of a first distillation column module in the construction of an assembled unit for incorporation into apparatus for the cryogenic distillation of air, said assembled unit being suitable for transportation to and erection at the site for a cryogenic air separation plant.

According to a sixth aspect of the present invention, there is provided use of a heat exchange module in the construction of an assembled unit for incorporation into apparatus for the cryogenic distillation of air, said assembled unit being suitable for transportation to and erection at the site for a cryogenic air separation plant.

According to a seventh aspect of the present invention, there is provided use of at least one fluid processing unit in the construction of an assembled unit for incorporation into apparatus for the cryogenic distillation of air, said assembled unit being suitable for transportation to and erection at the site for a cryogenic air separation plant.

According to an eighth aspect of the present invention, there is provided use of apparatus according to the first aspect of the present invention in the construction of a cryogenic air separation plant.

BRIEF DESCRIPTION OF THE DRAWINGS

The following is a description, by way of example only and with reference to FIG. 1 depicting a presently preferred embodiment of the apparatus of the present invention.

DETAILED DESCRIPTION OF THE INVENTION

Figure 1:
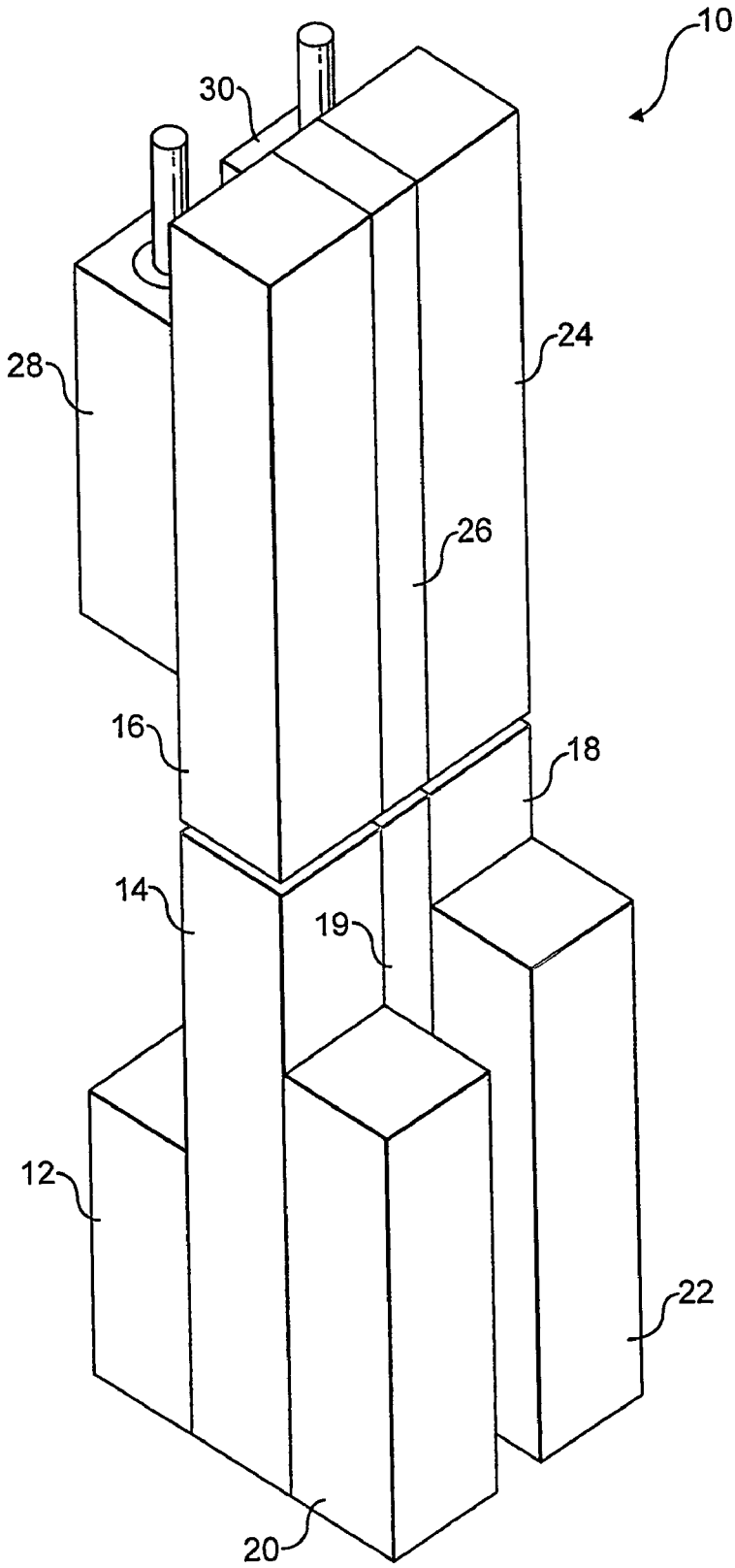

Referring to FIG. 1, the cryogenic air separation apparatus 10 comprises a number of modules. A heat exchange module 12 comprising heat exchange means (not shown) for cooling column feed air to a cryogenic temperature is mounted on one side and adjacent to the bottom portion of a first distillation column module 14 comprising a high pressure cryogenic distillation column (not shown).

A second distillation column module 16 comprising a low pressure cryogenic distillation column (not shown) is mounted on the top of the first distillation column module 14. The high pressure column and the low pressure column are thermally integrated with a reboiler-condenser (not shown) located in the sump of the low pressure column.

A first storage module 18 comprising a first storage unit (not shown) for storing a distillation product is mounted on another side and adjacent to the bottom portion of the first distillation column module 14 via a lower crossover structure 19.

A second storage module 20 comprising a second storage unit (not shown) for storing a distillation product is also mounted on and adjacent the bottom portion of the first distillation column module 14 but on the opposite side of the first distillation column module to the heat exchange module 12.

A third storage module 22 comprising a third storage unit (not shown) for storing a distillation product is mounted on one side of the first storage unit 18 and adjacent to both the first storage module 18 and the second storage module 20.

A third distillation column module 24 comprising an auxiliary distillation column (not shown) is mounted on and adjacent to the second distillation module 16 above the first storage module 18 via an upper crossover structure 26.

A first chiller tower 28 for cooling process streams is mounted on and adjacent to the second distillation column module 16 above the heat exchange module 12. A second chiller tower 30 for cooling process streams is mounted on and adjacent to both the third distillation column module 24 and the first chiller tower 28.

Each module further comprises pipe work (not shown) which, when connected to the pipe work of the relevant upstream and downstream components provided in adjacent modules, provides fluid flow communication and hence operational interconnection between the components of the apparatus. Furthermore, the distillation column modules are "cold boxes" further comprising insulation for the distillation columns contained therein.

During construction, the modules are positioned adjacent each other in the required positions relative to the first distillation column module 14. The pipe work within the modules is then connected and the modules are welded together.

Throughout the specification, the term "means" in the context of means for carrying out a function, is intended to refer to at least one device adapted and/or constructed to carry out that function.

It will be appreciated that the invention is not restricted to the details described above with reference to the preferred embodiments but that numerous modifications and variations can be made without departing from the spirit or scope of the invention as defined by the following claims.

The invention claimed is:

1. An apparatus for cryogenic distillation of air, said apparatus being a fully assembled unit, comprising:

a first self-contained distillation column module within which is provided a high pressure cryogenic distillation column;

a second self-contained distillation column module within which is provided a low pressure cryogenic distillation column, said second distillation column module being immediately adjacent to, mounted on top of, and attached directly to said first distillation column module;

a self-contained heat exchange module within which is provided a heat exchange means for cooling column feed air to a cryogenic distillation temperature, the self-contained heat exchange module being immediately adjacent and attached directly to at least one of the first self-contained distillation column module and the second self-contained distillation column module; and at least one self-contained further processing unit immediately adjacent and attached directly to at least one of the first self-contained distillation column module, the second self-contained distillation column module, and the self-contained heat exchange module, wherein the high pressure cryogenic distillation column, the low pressure cryogenic distillation column, said heat exchange means and each further processing unit are operationally interconnected, and wherein said fully assembled unit is adapted to be transported as a single pre-assembled fully assembled unit from a first location to a second location at a substantial distance from the first location, and wherein the transported single pre-assembled fully assembled unit is adapted to be erected as the fully assembled unit at a site for a cryogenic air separation plant designed to produce at least 2000 metric tons/day of a gas product.

2. An apparatus as claimed in claim 1 wherein a diameter of at least one of the high pressure cryogenic distillation column and the low pressure cryogenic distillation column is over about 3.5 m.

3. An apparatus as claimed in claim 1 wherein a diameter of at least one of the high pressure cryogenic distillation column and the low pressure cryogenic distillation column is about 5 m or about 6 m.

4. An apparatus as claimed in claim 1 further comprising a third self-contained distillation column module within which is provided an auxiliary distillation column or an argon side-arm column operationally interconnected with at least one of the high pressure cryogenic distillation column, and the low pressure cryogenic distillation column, the third self-contained distillation column module being adjacent and attached to at least one of the first self-contained distillation column module and the second self-contained distillation column module by a first cross-over structure between and adjoining the third self-contained distillation column module and at least one of the first and second distillation column modules.

5. An apparatus as claimed in claim 1 wherein the further processing unit is an air purification unit.

6. An apparatus as claimed in claim 5 wherein the air purification unit comprises at least two air purification vessels, each air purification vessel comprising at least one bed of carbon dioxide and/or water adsorbent material, said air purification vessels being arranged in parallel and configured for use in a temperature or a pressure swing adsorption process.

7. An apparatus as claimed in claim 1 wherein the at least one further processing unit is selected from the group consisting of a compressor for compressing feed air or other process gases, an expander for expanding liquid or gas streams, a chiller tower for cooling process water streams, a product compressor for compressing distillation products, a recycle compressor for compressing recycled gas stream(s), a pump for pumping distillation products, a "deoxo" unit for removing trace oxygen from a product gas stream, a dump vaporiser for vaporising liquid inventory from the apparatus, a silencer for reducing the noise given off by any process stream, a warm heat exchanger for warming process gas streams or a DCAC for cooling and drying air discharged from a compressor.

8. An apparatus as claimed in claim 1 wherein the at least one further processing unit is a chiller tower.

9. A method for construction of the apparatus as defined by claim 1, said method comprising:

providing the self-contained heat exchange module within which is provided the heat exchange means for cooling column feed air to a cryogenic distillation temperature, and the at least one self-contained further processing unit each in position immediately adjacent the first self-contained distillation column module within which is provided the high pressure cryogenic distillation column;

providing the second self-contained distillation column module within which is provided the low pressure cryogenic distillation column in position immediately adjacent to and mounted on top of the first self-contained distillation column module;

interconnecting operationally the high pressure cryogenic distillation column, the low pressure cryogenic distillation column, the heat exchange means and the further processing unit; and attaching the second self-contained distillation column module, the self-contained heat exchange module and the further self-contained processing unit each in position immediately adjacent the first self-contained distillation column module to form the fully assembled unit adapted to be transported as the single pre-assembled fully assembled unit adapted to be erected as the fully assembled unit at the site for the cryogenic air separation plant.

10. A method as claimed in claim 9, comprising the further steps of:

providing a third self-contained distillation column module containing another cryogenic distillation column operationally interconnected with at least one of the high pressure cryogenic distillation column and the low pressure cryogenic distillation column; and positioning the third self-contained distillation column module adjacent at least one of the first and second self-contained distillation column modules with a first cross-over structure positioned between and adjoining the third self-contained distillation column module and at least one of the first and second self-contained distillation column modules, wherein the another cryogenic distillation column is an auxiliary distillation column or an argon side-arm column.

11. A method for construction of a cryogenic air separation plant comprising constructing the apparatus defined in claim 1 to produce the fully assembled unit, transporting the single pre-assembled fully assembled unit to the site for the cryogenic air separation plant, and erecting the single pre-assembled fully assembled unit on site.

12. A method as claimed in claim 11 wherein construction takes place at a dockside or a construction facility with access to the dockside prior to transportation to the site for the cryogenic air separation plant by sea.

13. An apparatus for cryogenic distillation of air, said apparatus being a fully assembled unit, comprising:

a first self-contained distillation column module containing a high pressure cryogenic distillation column and a first set of conduits within the first self-contained distillation column module;

a second self-contained distillation column module containing a low pressure cryogenic distillation column and a second set of conduits within the second self-contained distillation column module, the second self-contained distillation column module being immediately adjacent to, mounted on top of, and attached directly to the first self-contained distillation column module, and the second set of conduits being in fluid flow communication with the first set of conduits;

a self-contained heat exchange module containing a heat exchange means in heat exchange communication with at least one of the high pressure cryogenic distillation column and the low pressure cryogenic distillation column, the self-contained heat exchange module being immediately adjacent and attached directly to at least one of the first self-contained distillation column module and the second self-contained distillation column module;

a self-contained further processing module containing a further processing unit and being immediately adjacent and attached directly to at least one of the first self-contained distillation column module, the second self-contained distillation column module, and the self-contained heat exchange module; and a self-contained storage module containing a storage unit for storing a distillation product, the self-contained storage unit being immediately adjacent and attached directly to at least one of the first self-contained distillation column module and the second self-contained distillation column module, wherein the high pressure cryogenic distillation column, the low pressure cryogenic distillation column, said heat exchange means, said further processing unit, and said storage unit are operationally interconnected, and wherein said fully assembled unit is adapted to be transported as a single pre-assembled fully assembled unit from a first location to a second location at a substantial distance from the first location, and wherein the transported single pre-assembled fully assembled unit is adapted to be erected as the fully assembled unit at a site for a cryogenic air separation plant designed to produce at least 2000 metric tons/day of a gas product.

14. An apparatus as in claim 13, comprising:

a third self-contained distillation column module containing another cryogenic distillation column operationally interconnected with at least one of the high pressure cryogenic distillation column and the low pressure cryogenic distillation column, the third self-contained distillation column module being adjacent and attached to at least one of the first self-contained distillation column module and the second self-contained distillation column module by a first cross-over structure between and adjoining the third self-contained distillation column module and at least one of the first and second distillation column modules, the another cryogenic distillation column being an auxiliary distillation column or an argon side-arm column.

15. An apparatus as in claim 13, comprising:

another self-contained storage module adjacent and attached to at least one of the first and second self-contained distillation column modules by another cross-over structure between and adjoining the another self-contained storage module and at least one of the first and second self-contained distillation column modules.

16. A method for installing a fully assembled unit for cryogenic distillation of air, comprising the steps of:

providing a first self-contained distillation column module containing a high pressure cryogenic distillation column and a first set of conduits within the first self-contained distillation column module;

providing immediately adjacent to and mounted on top of the first self-contained distillation column module a second self-contained distillation column module containing a low pressure cryogenic distillation column and a second set of conduits within the second self-contained distillation column module;

attaching the first self-contained distillation column module directly to the immediately adjacent second self-contained distillation module;

placing in fluid flow communication the first set of conduits within the first self-contained distillation column module with the second set of conduits within the second self-contained distillation column module;

providing a self-contained heat exchange module containing a heat exchange means in heat exchange communication with at least one of the high pressure and low pressure cryogenic distillation columns, the heat exchange module being immediately adjacent to and operationally interconnected with at least one of the first self-contained distillation column module and the second self-contained distillation column module;

attaching the self-contained heat exchange module directly to at least one of the immediately adjacent first and second distillation column modules;

providing a self-contained further processing module containing a further processing unit and being immediately adjacent to and operationally interconnected with at least one of the first self-contained distillation column module, the second self-contained distillation column module, and the self-contained heat exchange module;

attaching the self-contained further processing module directly to at least one of the immediately adjacent first self-contained distillation column module, the second self-contained distillation column module, and the self-contained heat exchange module; and interconnecting operationally the high pressure cryogenic distillation column, the low pressure cryogenic distillation column, the heat exchange module and the further processing unit, wherein said fully assembled unit is adapted to be transported as a single pre-assembled fully assembled unit from a first location to a second location at a substantial distance from the first location, and wherein the transported single pre-assembled fully assembled unit is adapted to be erected as the fully assembled unit at a site for a cryogenic air separation plant designed to produce at least 2000 metric tons/day of a gas product.

17. The method of claim 16, comprising the further step of:

transporting the fully assembled unit as a single pre-assembled fully assembled unit from the first location to the second location at a substantial distance from the first location.

18. The method of claim 17, comprising the further step of:

erecting the single pre-assembled fully assembled unit at the site for the cryogenic air separation plant.

19. The method of claim 17, wherein the first location is at a dockside or a facility with access to the dockside and the single pre-assembled fully assembled unit is transported by sea from the dockside to the second location.

20. The method of claim 19, wherein the second location is at or near the site for the cryogenic air separation plant.

21. The method of claim 16, comprising the further steps of:

providing a third self-contained distillation column module containing another cryogenic distillation column operationally interconnected with at least one of the high pressure cryogenic distillation column and the low pressure cryogenic distillation column; and positioning the third self-contained distillation column module adjacent at least one of the first and second self-contained distillation column modules with a first cross-over structure positioned between and adjoining the third self-contained distillation column module and at least one of the first and second self-contained distillation column modules, wherein the another cryogenic distillation column is an auxiliary distillation column or an argon side-arm column.

22. The method of claim 16, comprising the further steps of:

providing a self-contained storage module containing a storage unit for storing a distillation product; and positioning the self-contained storage module adjacent at least one of the first and second self-contained distillation column modules with an other cross-over structure positioned between and adjoining the self-contained storage module and at least one of the first and second self-contained distillation column modules.

* * * * *